US006254190B1

(12) United States Patent
Gregory

(10) Patent No.: US 6,254,190 B1
(45) Date of Patent: Jul. 3, 2001

(54) CHAIR HAVING A SEAT WITH DIFFERENTIAL FRONT AND REAR SUPPORT PORTIONS

(76) Inventor: Peter G. G. Gregory, 113 Cowpasture Rd., Wetherill Park, New South Wales (AU)

( * ) Notice: Subject to any disclaimer, the term of this patent is extended or adjusted under 35 U.S.C. 154(b) by 0 days.

(21) Appl. No.: 09/409,024

(22) Filed: Sep. 29, 1999

(51) Int. Cl.[7] ..... A47C 7/02

(52) U.S. Cl. ..... 297/452.1; 297/440.11

(58) Field of Search ..... 297/440.1, 440.11, 297/452.13, 452.18, 452.1, 284.1, 463.2, 452.38

(56) References Cited

U.S. PATENT DOCUMENTS 5,318,348 * 6/1994 Hess .
5,662,383 * 9/1997 Hand .
5,762,403 * 6/1998 Robinson .

* cited by examiner

*Primary Examiner*—Milton Nelson, Jr.

(57) ABSTRACT

A chair including a novel seat construction which includes in the illustrated embodiment a single sheet of fabric having a front support portion of relatively high resistance to resilient deformation and a rear support portion of relatively low resistance to resilient deformation. The differential deformation of the two regions locates an occupant's ischial tuberosity behind the forward support portion which thereby resists forward movement of the sitter from the chair to thus retain the sitter back in its correct position.

11 Claims, 4 Drawing Sheets

CHAIR HAVING A SEAT WITH DIFFERENTIAL FRONT AND REAR SUPPORT PORTIONS

TECHNICAL FIELD

Chair designs have been continually refined in order to insure that the occupant is seated with the correct posture to minimize and hopefully eliminate back pain. While the perfect chair has yet to be invented substantial strides have been made and continue to be made.

BACKGROUND ART

Various attempts have been made to design a chair that will insure correct posture and one such chair has been invented by the subject inventor as disclosed in U.S. Pat. No. 4,889,387. The chair in question while very satisfactory is somewhat complex and sufficiently costly that it does not lend itself to being used in a chair that is priced sufficiently low to reach a mass market and thus provide the desired benefit to a very large number of consumers. In essence there has long been a need to provide a relatively low cost chair that will maintain a sitter in the desired correct posture while resisting forward movement of the sitter from the seat.

SUMMARY OF THE INVENTION

In accordance with the present invention there is provided a novel chair construction that is capable of having all the desired movements including seat height and tilt adjustment, synchronized back and seat angle adjustment and incorporates a novel seat construction that will provide the desired posture support. The seat is composed of a single sheet of fabric or mesh material having a front portion that is more resistant to deformation than its rear portion. The front portion is composed of high resilient elastic fibers that is tighter in construction than the rear softer portion that comprises less resilient elastic fibers. The sheet of fabric or mesh having the desired dual density resilience is formed of separate sections of fiber that are woven or sealed together to form a single fabric. Prior to installation in the seat frame the fabric is prestretched and while in its stretched condition is inserted into recesses in the seat frame and maintained in the stretched condition by suitable locking inserts.

The novel aspects of the applicant's invention will be apparent from the drawings and attached description.

DESCRIPTION OF THE INVENTION

Figure 1:
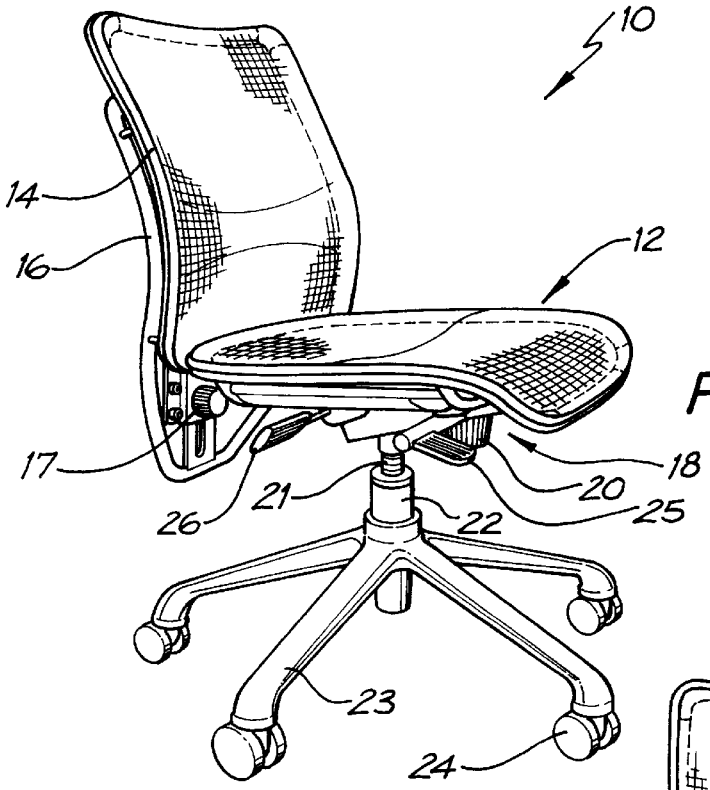
FIG. 1 is a perspective view of a chair incorporating applicant's invention.

Referring first to FIG. 1 there is illustrated a perspective view of a chair 10 incorporating applicant's invention. The illustrated chair is merely representative of a chair that would employ applicant's novel seat construction. While various adjustment features will be disclosed and referred to these features are common to chairs of this type and are not essential to applicant's invention. They are described and illustrated so that one may have a complete understanding of the operation and construction of a chair and the environment in which applicant's invention is used.

Essentially, the chair 10 of FIG. 1 includes a seat assembly 12 which is an inclined or inclinable seat, a back section 14 and a back support 16 for the back section 14. There is provided an adjustable connection 17 for the back section 14 and support 16 relative to the seat assembly 12. The seat support structure 18 supports the seat assembly 12, back section 14 and back support 16 relative to the seat column 21 that is located in a tubular support 22. The tubular support 22 is affixed to a leg assembly 23 that is supported on wheels 24.

It is to be noted that the seat support structure also includes a tension adjustment 20 for the seat back section 14 and back support 16, a height adjustment mechanism 25 and a seat tilting mechanism 26.

Figure 5:
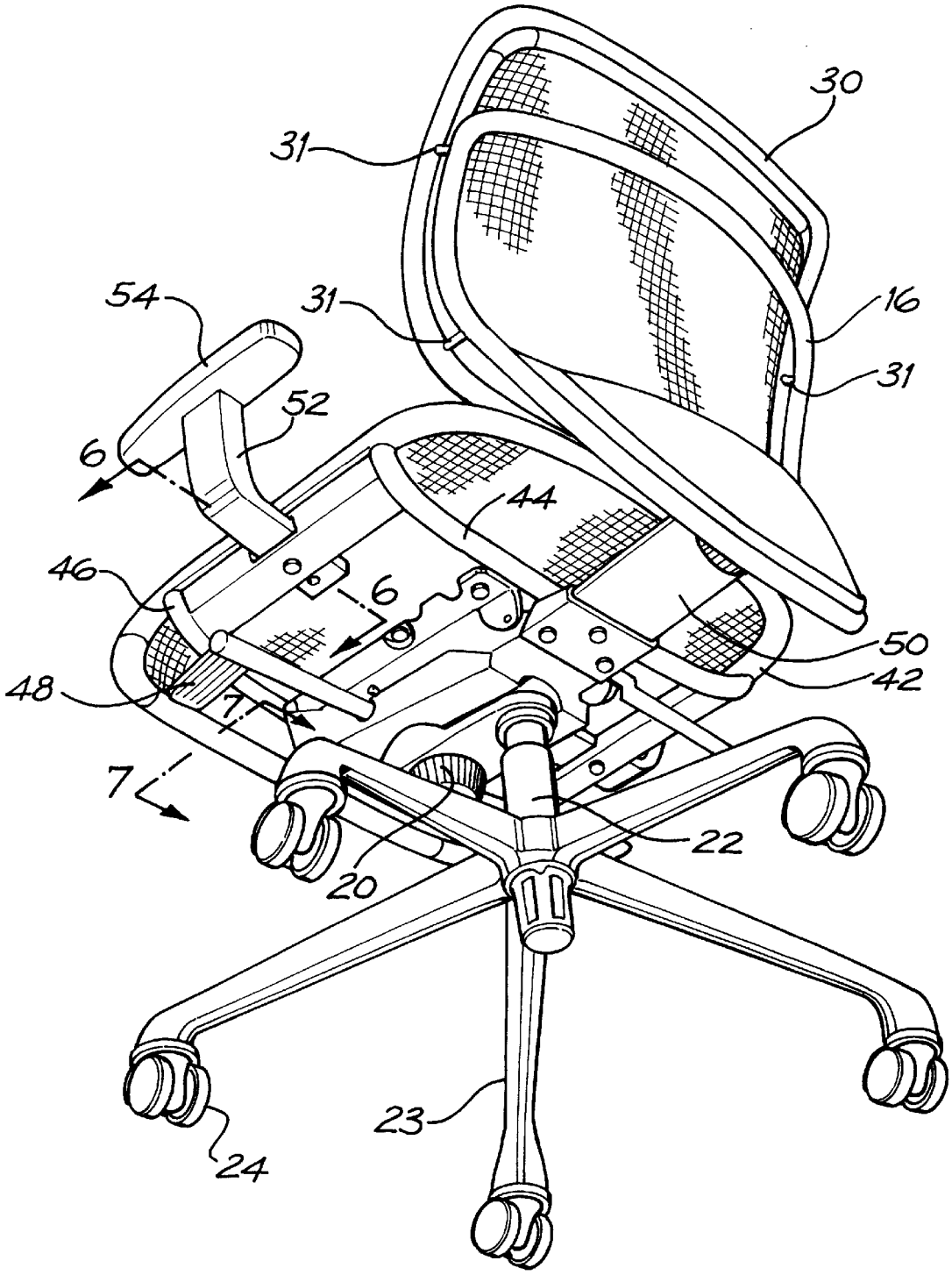
FIG. 5 is a view of the undersection of the chair.

The back section 14 is made up of a back frame 30, in which is disposed, a back fabric 28 that is suitably secured in place under tension to support the sitters back. The back section 14 is connected to the back support 16 by connectors 31 as shown in FIG. 5.

Figure 3:
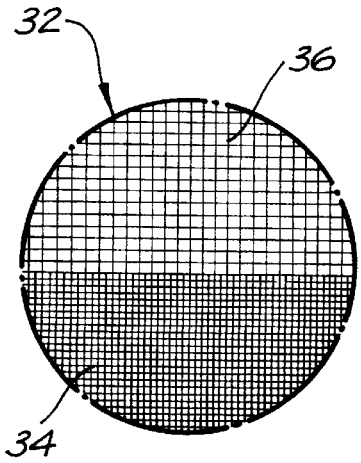
FIG. 3 is a view showing the fabric construction of the portion circled in FIG. 2.
Figure 2:
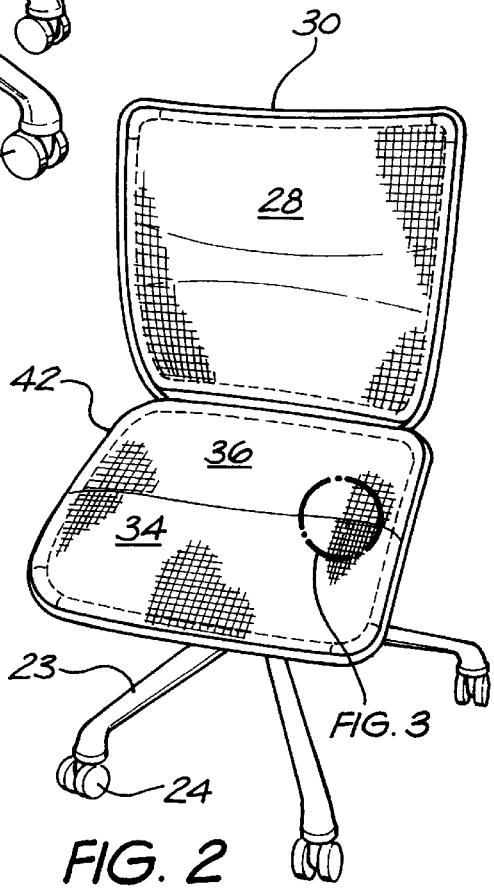
FIG. 2 is a front view of the chair.
Figure 6:
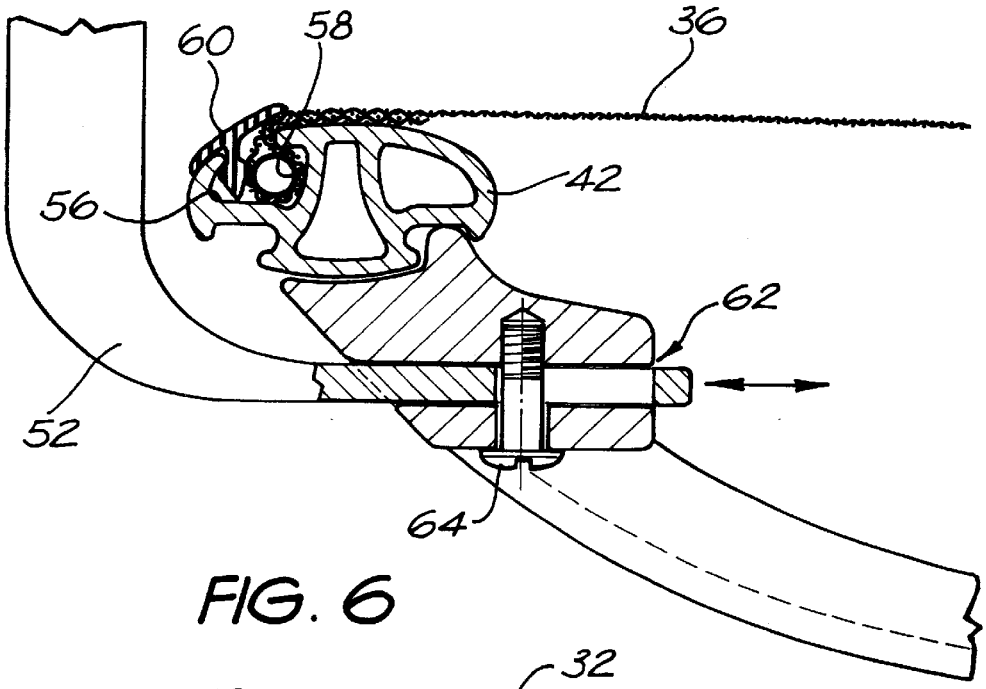
FIG. 6 is a view taken along line 6—6 of FIG. 5.
Figure 7:
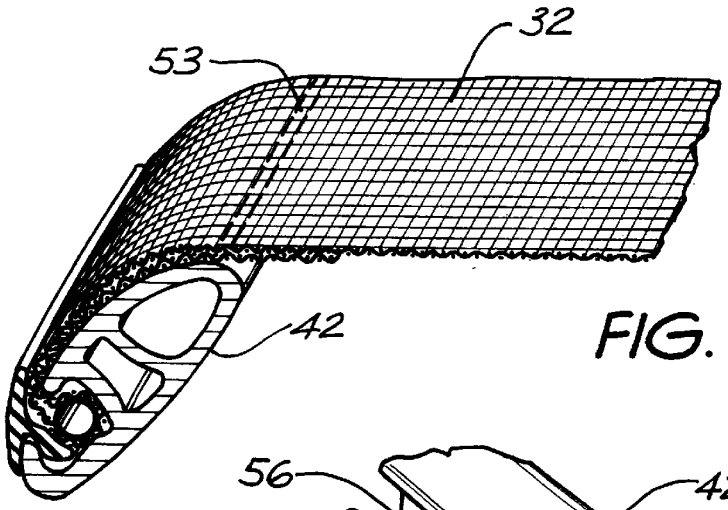
FIG. 7 is a view taken along 7—7 of FIG. 5.

Turning now to the applicants novel seat construction reference is specifically made to FIGS. 2 and 3 which illustrates the seat fabric in place and its construction and FIGS. 6 and 7 which show the details of how the seat fabric 32 is secured in place relative to the seat frame 42. The seat fabric 32 is a single unitary sheet made of two sections of woven material secured together by weaving, heat sealing or other suitable methods. The seat fabric 32 consists of a front seat fabric section 34 and a rear seat fabric section 36 that is normally about 15% to 20% softer than the front seat fabric section. The difference in the weaving construction of the seat fabric can be seen in FIG. 3 in which the front seat fabric section 34 contains more resilient mesh than that rear seat fabric section 36 that consists of less resilient mesh. The resiliency can be changed by changing the diameter of the elastomeric fibers or by changing the number of fibers or by any other method that will effect resilience.

In a preferred embodiment the seat fabric is made of polyester elastomeric fibers in which the front section 34 is made of a dual tension high resilient mesh and the rear section 36 is made of a less resilient mesh. The front section is made more elastic and has less tendency to stretch and thus is more resistant. It is essential to note that the formed single piece of material 32 is fixed in place in the front seat frame 42 after being prestretched from its normally unstretched condition. This method of assembly will be described in more detail in connection with FIGS. 6 and 7.

Figure 4:
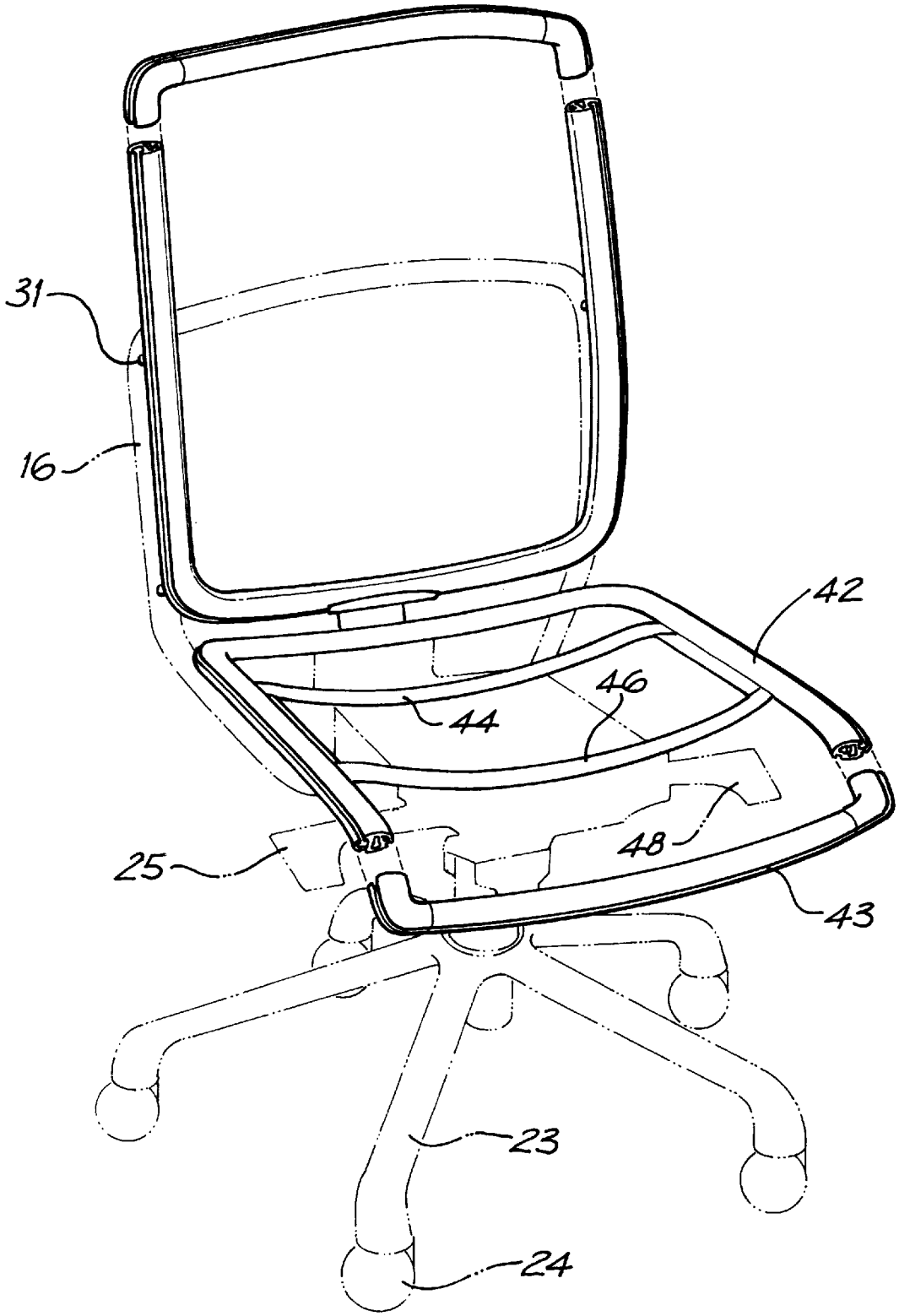
FIG. 4 is a view showing the framing construction of the seat and back portion.

Turning again to the seat construction it is seen from FIG. 4 that the frame 42 is an aluminum extrusion that is generally U-shaped to which the fabric is tightly secured and this U-shaped extrusion is enclosed by an end piece 43. To provide additional support for the seat frame 42 are support bars 44, 46.

In FIG. 4 there is also illustrated the synchronized back and seat angle adjustment 48. During this adjustment the back moves approximately twice that of the seat.

FIG. 5 illustrates in some detail the underseat construction of the chair including in addition to the aforementioned seat and back adjustments the support structure 50 for supporting the back assembly relative to the main underseat frame construction. It is also noted that the chair of FIG. 5 includes an adjustable arm support 52.

In FIG. 6 and 7 are illustrated the details of the adjustable arm support 52 and most importantly the assemblage of the seat fabric 32 that is held under tension in the U-shaped front seat frame 42. As shown in FIG. 7 the overlapped portions of the fabric are secured together by threads 53.

Figure 8:
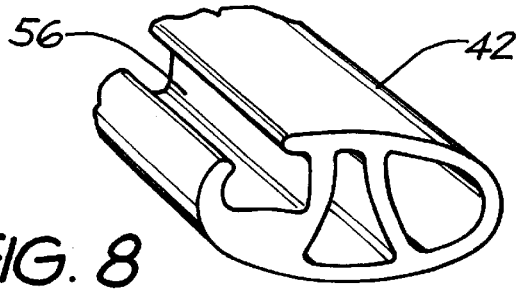
FIG. 8 is a perspective view of the aluninum extrusion.
Figure 9:
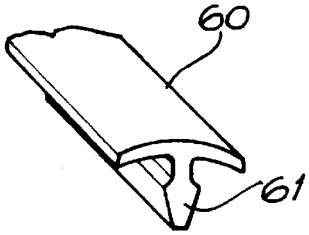
FIG. 9 is a perspective view of the longitudinally extending T-shaped member for retaining the fabric in position under tension.

The U-shaped frame section 42 is an aluminum extrusion (see FIG. 8) that is suitably secured to and supported by the seat frame members 44, 46. The extrusion 42 includes a longitudinally extending recess 56 in which the seat fabric is secured after it has been prestretched the desired amount which by way of example only may be 12% more than its unstretched length. The novel machine used for stretching includes a series of clamps that hold the fabric and then stretches the fabric to the desired length so that the excapsulated beading 58 can be fed into the recess 56 before the T-section 60 is positioned above and beside the mesh encapsulated beading. With the bead 58 located in the recess 56 a longitudinally extending T-shaped member 60 (see FIG. 9) is located in the recess 56 to secure the bead 60 and thus the fabric 32 in its extended stressed condition to form applicants novel seat which will support and occupant in the correct posture position while resisting forward movement of the sitter from the seat. This is accomplished by forming the seat fabric with a front portion 34 that is more resistant to deformation than the rear portion 36, which contains less fibers and is thus less resistant to deformation.

It remains to note that the arm rest 54 includes arm support openings 62 which provides for selective positioning of the arms relative to the seat. After the arm is properly positioned a fastener 64 is employed to secure the arm rest in place.

It is intended to cover by the appended claims all features, which come within the true spirit and scope of the invention.

What is claimed is:

1. A chair having a seat assembly and a back support assembly, the seat assembly including a seat frame; sheet material that is stretched and secured in place relative to said frame, said sheet material defining a front support portion and a rear support portion wherein said front support portion is of relatively high resistance to resilient deformation and said rear support portion is of relatively low resistance to resilient deformation such that a person sitting on the chair causes differential deformation whereby said rear support portion is deformed to a greater extent than said front support portion, the differential deformation of the front and rear support portions acting to locate the person's ischial tuberosity behind the front support portion thereby resisting forward movement of the person from the chair.

2. A chair according to claim 1 wherein said rear support portion is 15 to 20 percent more compliant than said front support portion.

3. A chair according to claim 1 wherein said forward support portion and rear support portion are formed from a unitary sheet material.

4. A chair according to claim 1 wherein said front support portion is stretched to a greater extent than said rear support portion.

5. A chair according to claim 1 wherein said seat frame includes an extruded section defining a recess in which said sheet material is secured in place.

6. A chair according to claim 5 wherein said section is extruded from aluminum.

7. A chair according to claim 5 wherein said sheet material includes a bead along a pair of opposing edges, said bead being located and retained in said recess of said extruded section to secure said sheet material in place relative to said frame.

8. A chair according to claim 7 wherein said bead is retained in said recess by at least one substantially T-shaped member.

9. A chair according to claim 1 wherein said sheet material is woven.

10. A chair according to claim 9 wherein said front support portion has more fibers per inch than said rear support portion.

11. A chair according to claim 9 wherein said sheet material is woven from polyester elastomeric fibers.

* * * * *